US005207625A

United States Patent [19]

White

[11] Patent Number: 5,207,625

[45] Date of Patent: May 4, 1993

[54] COLLAPSIBLE SWING MOTION DEVICE

[76] Inventor: Philip R. White, 3435 Channel Way, San Diego, Calif. 92110-5104

[21] Appl. No.: 848,522

[22] Filed: Mar. 9, 1992

[51] Int. Cl.[5] ..... A63B 21/008

[52] U.S. Cl. ..... 482/111; 273/26 R; 273/29 A; 273/186.2; 273/193 A

[58] Field of Search ..... 482/111; 273/26 R, 26 B, 273/29 A, 35 R, 186 R, 186 A, 193 A

[56] References Cited

U.S. PATENT DOCUMENTS 3,809,397 5/1974 Gruenewald ..... 273/26 B
4,416,451 11/1983 Solloway ..... 482/111
4,576,378 3/1986 Backus ..... 273/186 A
5,002,275 3/1991 Beutler et al. ..... 482/111
5,058,890 10/1991 Szabo ..... 273/26 R
5,100,148 3/1992 Smith ..... 273/186 A

*Primary Examiner*—Richard J. Apley
*Assistant Examiner*—Lynne A. Reichard
*Attorney, Agent, or Firm*—Brown, Martin, Haller & McClain

[57] ABSTRACT

A swing motion device for providing exercise and training has a plurality of collapsible vanes mounted on a shaft that an athlete may grip and swing through the air. The vanes provide air resistance against which the athlete's muscles must work. Each vane may comprise a foldable wire framework covered with a bag-like fabric sheath. When the vanes are collapsed, the device assumes a compact shape that facilitates transport and storage.

18 Claims, 2 Drawing Sheets

COLLAPSIBLE SWING MOTION DEVICE

BACKGROUND OF THE INVENTION

The present invention relates generally to athletic training and exercise equipment and, more specifically, to a resistance training device for improving the swing of a golfer, baseball player, and athletes engaged in similar sports.

Athletic training equipment is often tailored to suit the needs of athletes engaged in specific sports. For example, machines that simulate cross-country skiing and rowing are available. In addition to providing aerobic exercise and improving cardiovascular fitness, these devices strengthen muscles by providing resistance against which the muscles must work. However, rather than being generalized resistance training machines, these machines target specific muscle groups involved in performing the repetitive motion by providing resistance peculiar to a particular motion. Such devices allow the athlete to train under controlled conditions that closely approximate the actual sport. Under these controlled conditions, the athlete may focus on improving a particular aspect of the repetitive motion involved in the sport in addition to increasing his endurance and strength.

Although specialized training equipment exists for many sports, there is a need for a device that provides resistance against the "swing" motion of a golfer or baseball batter. The motion involved in swinging a club or bat is more complex than that involved in rowing, skiing, cycling, and similar sports. A training device that in any way inhibits the graceful arch of a golfer's swing would defeat its own purpose. A training device for swing motion must allow full unrestricted movement in all directions.

U.S. Pat. No. 3,809,397 issued to Gruenewald describes a swing motion device that uses air resistance. The device has a plurality of flat vanes fixedly mounted on a hollow shaft. The use of air resistance rather than a more complex mechanical system allows unrestricted motion and is economical of manufacture. However, the large vanes extending from such a device inhibit convenient transport and storage. A swing motion training device having folding vanes would be compact, portable, and economical of manufacture. These problems and deficiencies are clearly felt in the art and are solved by the present invention in the manner described below.

SUMMARY OF THE INVENTION

The present invention comprises a shaft and a plurality of foldable fabric-covered vanes extending therefrom for providing air resistance. When the vanes are extended, the device may be swung by a golfer or batter to improve his form and condition the specific muscles involved in a swinging motion. When the vanes are folded, the device assumes a compact shape that facilitates transport and storage.

Each vane may have any number of sides when extended, such as four for a rectangular vane or three for a triangular vane. Each vane comprises a collapsible framework of a suitable material such as rigid wire. The framework is hingedly attached to the shaft at one or more points. Each vane, when extended, should lie in a plane that is parallel or substantially parallel to the shaft to maximize air resistance as the device is swung.

The framework of each vane may collapse towards the shaft in any suitable manner. For example, the framework of each vane may have three hingedly connected members that together with the shaft define a rectangle when fully extended. This rectangular vane collapses into a progressively longer parallelogram as it folds. When fully folded, the vane lies close to the shaft in a tight parallelogram. Alternatively, the framework of each vane may collapse towards the shaft in an accordian-like fashion. In any embodiment, the framework may be springbiased to automatically extend or collapse the vanes.

The fabric covering may comprise a bag-like cover that is fitted over the framework of each vane. It may remain connected while the vane is folded or it may be removed prior to folding and stored or transported separately.

To simulate the feel of a club or bat, the shaft may have a length substantially equal to that of a club or bat with the vanes disposed near one end and a hand grip at the other end. Such a shaft may be solid or hollow and may be formed from any suitable material such as metal, plastic or wood. The grip itself and the end of the shaft near the grip may have the appearance of a golf club or baseball bat for added realism. Alternatively, the shaft may comprise a hollow tube having a length substantially equal to that of the vanes. The hollow tube is slipped over the grip end of a golf club, for example, slid down the shaft of a club, and retained against the head of the club. Similarly, if the device is to be used in conjunction with a bat, it may be slipped over the narrow grip portion and wedged against the widest portion of a bat.

BRIEF DESCRIPTION OF THE DRAWINGS

The foregoing, together with other features and advantages of the present invention will become more apparent when referring to the following detailed description in which reference numerals refer to the drawings in which.

DESCRIPTION OF THE PREFERRED EMBODIMENTS

Figure 1:
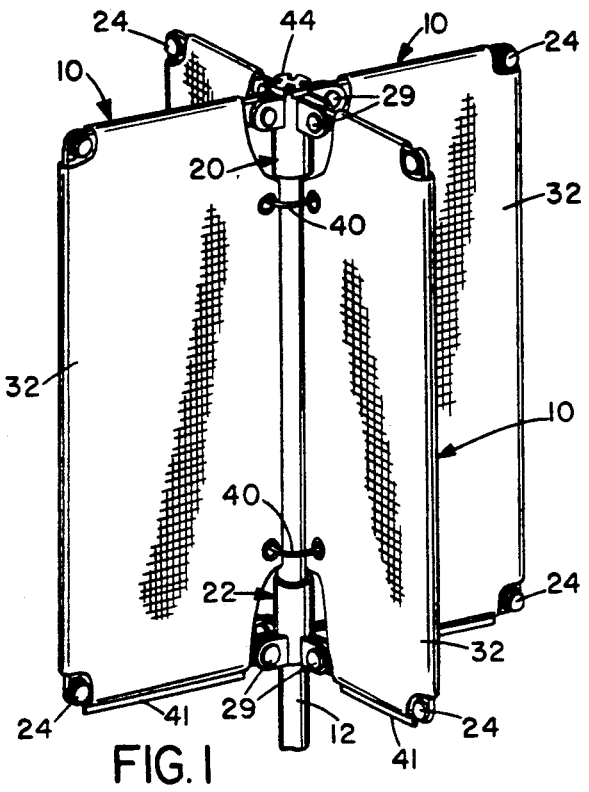
FIG. 1 is a perspective view of a swing motion training device with the vanes in an extended position.
Figure 2:
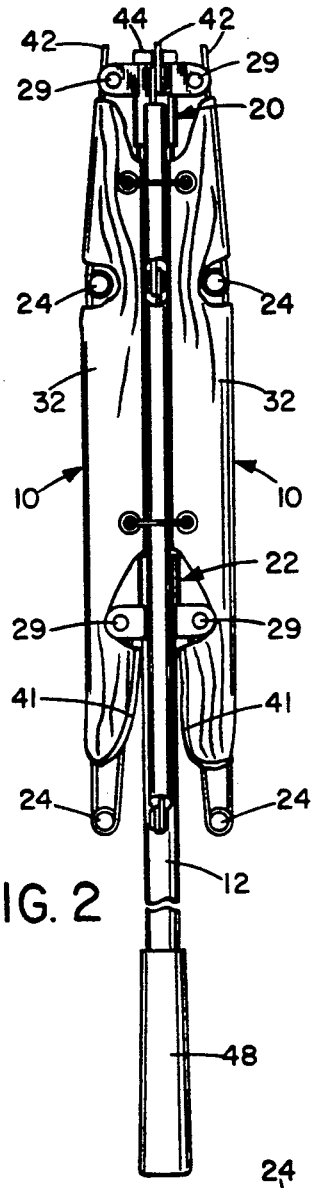
FIG. 2 is a side view of a swing motion training device showing the vanes in a collapsed position.
Figure 3:
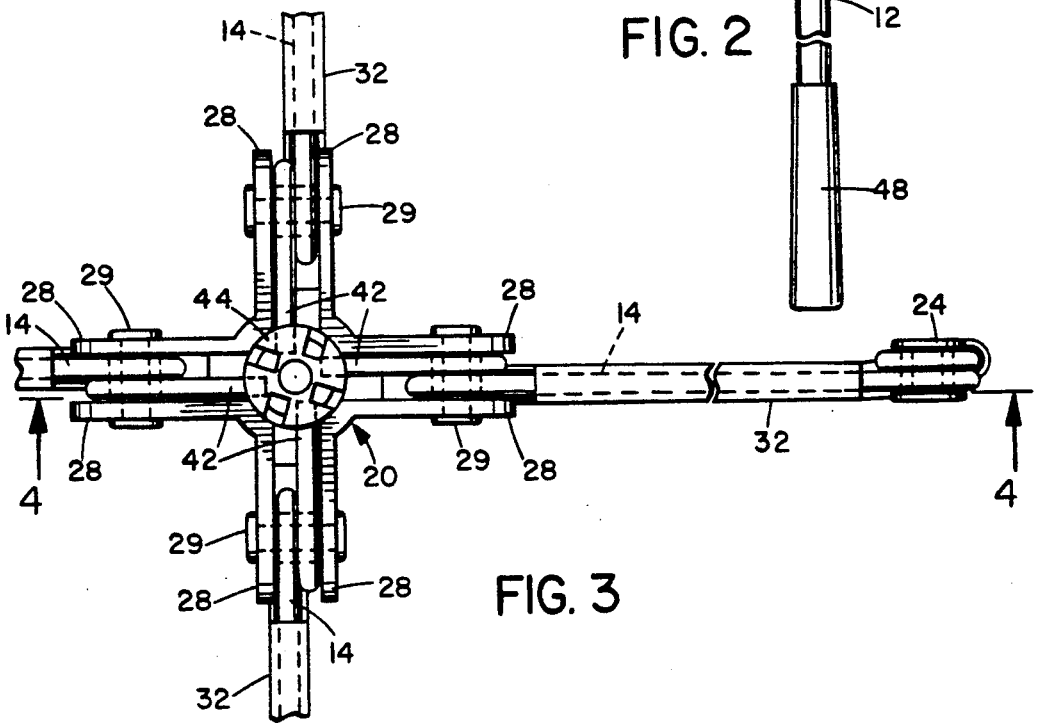
FIG. 3 is an enlarged top plan view showing the hub area.

The present invention comprises a plurality of identical folding vanes 10 radially connected to a shaft 12. Four such vanes 10 are preferred. In FIG. 1, each vane 10 assumes a rectangular shape in its extended position, although it may assume another shape such as a triangle in other embodiments. Each vane 10 collapses inwards towards shaft 12 to facilitate storage and transport, as shown in FIG. 2.

Figure 4:
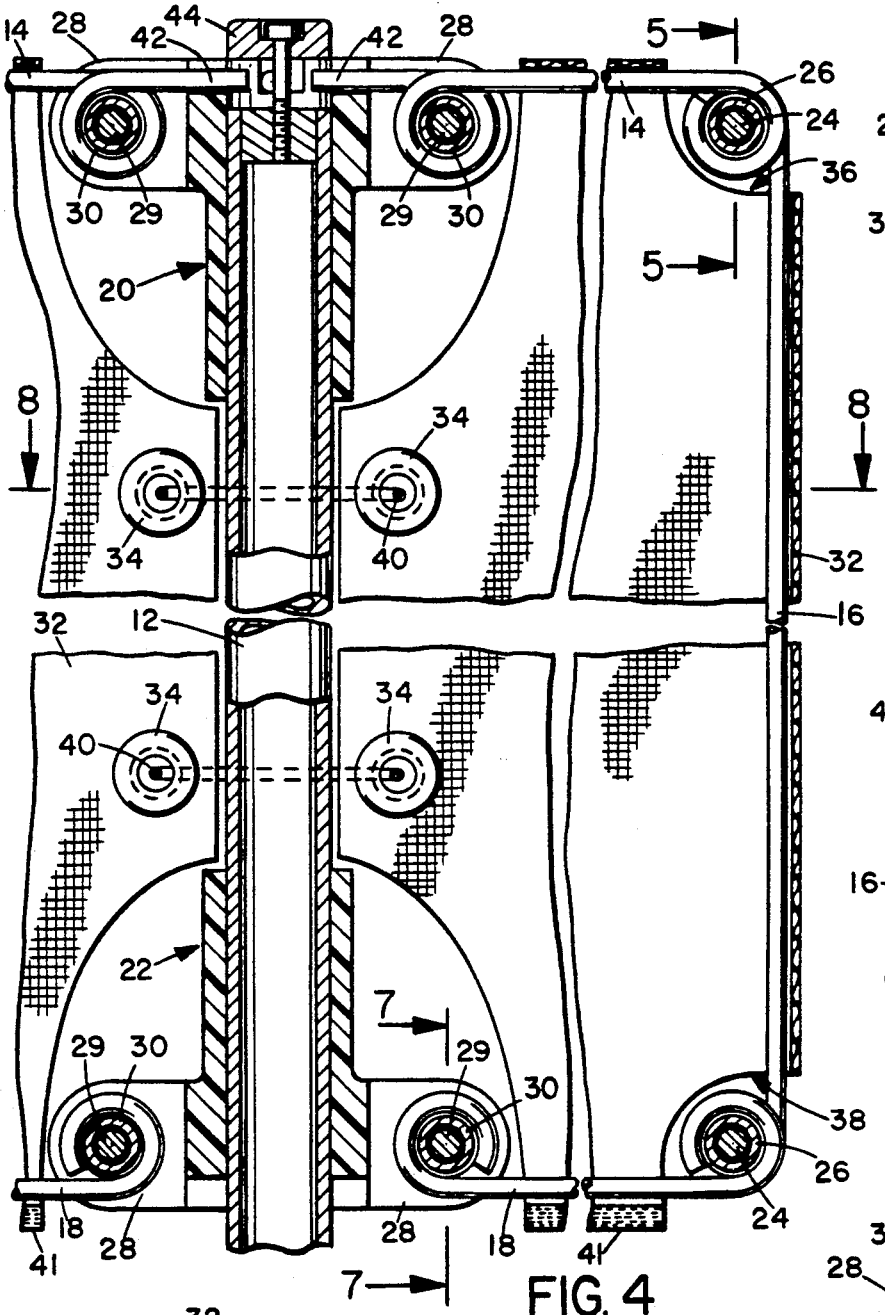
FIG. 4 is a side view, partially cut-away, showing the top and bottom portions of a vane.

In FIG. 4, each vane 10 comprises a framework of three wires 14, 16, and 18, that are hingedly connected to each other and to two hubs 20 and 22, mounted on shaft 12 Wires 14, 16, and 18 define three sides of a rectangular vane and the portion of shaft 12 between wires 14 and 18 defines the fourth side. These hinged connections allow each vane 10 to collapse into a compact parallelogram, although it may collapse in any suitable manner, such as an accordian-like manner, with the addition of further hinged connections in the sides.

Figure 5:
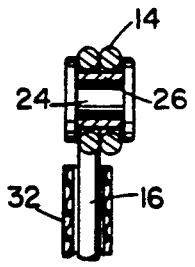
FIG. 5 is a sectional view taken along line 5—5 of FIG. 4.
Figure 7:
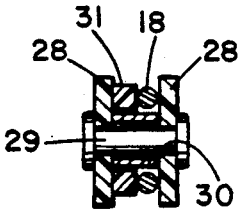
FIG. 7 is a sectional view taken along line 7—7 of FIG. 4.
Figure 8:
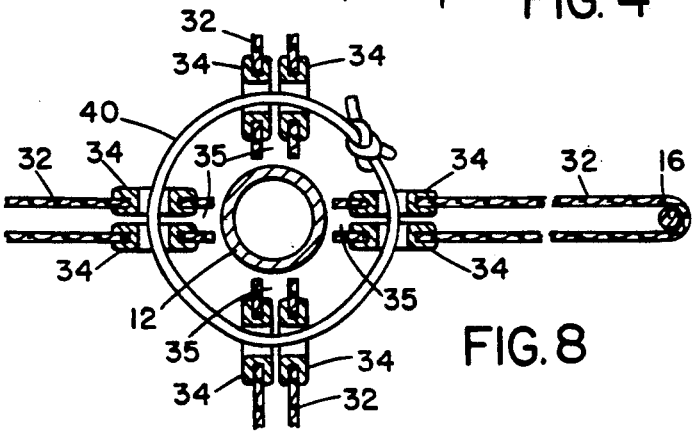
FIG. 8 is a sectional view taken along line 8—8 of FIG. 4.

The hinged connections are formed by bending a circular loop or eye into each end of wires 14–18. As shown in FIG. 5, the hinged connection between wires 14 and 16, as well as that between wires 16 and 18, is completed by aligning the eyes and inserting a cylindrical fastener 24 such as a rivet or bolt through the eyes. Each fastener 24 may have a bushing 26 for decreasing friction in the hinged connection. Similarly, as shown in FIG. 7, the hinged connection between wire 14 and hub 20, as well as that between wire 18 and hub 22, is completed by aligning the eyes between the forks 28 of each hub and inserting a cylindrical fastener 29 such as a rivet or bolt. Each fastener 29 may have a bushing 30 for decreasing friction. A spacer 31 may also be included if forks 28 are wider than the wires.

A fabric cover 32 over each vane 10 provides air resistance as the device is swung through the air. Cover 32 is a bag-like sheath having an opening 35 along one edge that is slipped over each vane 10. The two corners of cover 32 nearest shaft 12 may be cut away to provide openings for facilitating folding of cover 32. Additional corner openings 36 and 38 may be provided at the hinged connection between wires 14 and 16 and at the hinged connection between wires 16 and 18 respectively to further facilitate folding of cover 32. Cover 32 has one or more eyelets 34 for securing it to shaft 12 using a tie 40

As vane 10 is collapsed, cover 32 tends to slip relative to wires 14, 16, and 18 in a direction away from hub 20. Some such slippage is expected and does not inhibit folding of vane 10. Cover 32 may fit snugly or loosely over the framework of vane 10. To further facilitate either removal of cover 32 from vane 10 or folding of vane 10 with cover 32 in place, cover 32 may have a closure along one or more edges. In FIGS. 1 and 4, closure 41, which may be a VELCRO® hook-and-loop type strip, is disposed along the edge of cover 32 adjacent to wire 18.

To extend a collapsed vane 10, the athlete may simply grasp it and pull it outwards or he may extend a collapsed vane 10 by swinging the device, thereby utilizing centrifugal force.

Figure 6:
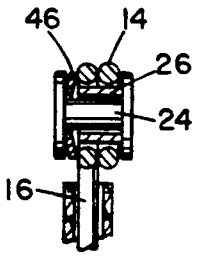
FIG. 6 is a view similar to FIG. 5 and includes a spring washer.

An extension 42 in the end of wire 14 contacts hub 20 when vane 10 is fully extended and prevents further extension. The athlete may rotate a slotted locking cap 44, disposed on hub 20 to prevent the extended vane 10 from collapsing. However, as shown in FIG. 6, a spring washer 46 may be included in any of the hinged connections to provide sufficient frictional force to maintain vane 10 in any position without using locking cap 44.

Shaft 12 may be hollow. It may have a length substantially equal to that of wire 16 of vane 10. The athlete slips shaft 12 over the grip end of a golf club or bat (not shown) where it is retained against the head of the club or the wide portion of the bat. In another embodiment, shaft 12 is longer than wire 16 and includes a hand grip 48, which may simulate the grip of a bat or golf club.

Obviously, other embodiments and modifications of the present invention will occur readily to those of ordinary skill in the art in view of these teachings. Therefore, this invention is to be limited only by the following claims, which include all such other embodiments and modifications when viewed in conjunction with the above specification and accompanying drawings.

I claim:

1. A swing device for providing air resistance to swinging motion, comprising:

a shaft; and a plurality of collapsible vanes, each connected to said shaft, each having a collapsed and extended position, each lying in a plane parallel to said shaft and radially extending from said shaft in said extended position, and each restrained against movement outside said plane during movement of said vane between said extended and collapsed positions.

2. A swing device as described in claim 1, wherein said shaft is a hollow tube.

3. A swing device as described in claim 1, wherein said vanes are connected to said shaft at equally spaced points about said shaft.

4. A swing device as described in claim 3, wherein each said vane has first, second, third, and fourth sides.

5. A swing device as described in claim 4, wherein said fourth side of each said vane is parallel to and adjacent to said shaft.

6. A swing device as described in claim 5, wherein the number of vanes of said plurality is four.

7. A swing device as described in claim 6, wherein each said vane comprises:

a frame having first, second, and third members corresponding to said first, second, and third sides of said vane respectively;

said first and third members each having an end hingedly connected to said second member and an end hingedly connected to said shaft; and a cover disposed on said frame, said cover having four edges corresponding to said sides of said vane.

8. A swing device as described in claim 7, wherein said cover is fabric.

9. A swing device as described in claim 8, wherein each said member comprises a wire having an eye formed in each said hingedly connected end.

10. A swing device as described in claim 9, further comprising a plurality of cylindrical fasteners, one said fastener disposed through said eyes at each said, hinged connection.

11. A swing device as described in claim 10, further comprising a retainer for securing said vanes in said extended position.

12. A swing device as described in claim 11, wherein said retainer comprises a rotary locking cap disposed on said shaft.

13. A swing device as described in claim 12, wherein said cover comprises a bag having an opening along at least one said edge.

14. A swing device as described in claim 13, wherein one said opening is along said fourth edge of said cover.

15. A swing device as described in claim 14, wherein said cover further comprises a closure along at least one said edge.

16. A swing device as described in claim 15, wherein said cover has a first corner opening between, said first and second edges and a second corner opening between said second and third edges.

17. A swing device as described in claim 16, wherein said cover further comprises a plurality of eyelets adjacent to said fourth edge for attaching said cover to said shaft.

18. A swing device as described in claim 17, further comprising a hand grip on said shaft.

* * * * *